US005609246A

United States Patent [19]

Borghorst et al.

[11] Patent Number: 5,609,246

[45] Date of Patent: Mar. 11, 1997

[54] BLISTER PACK FOR AN OPTICAL LENS

[75] Inventors: Sharla Borghorst, Frankfurt am Main; Erich Baumann, Goldbach; John Golby, Aschaffenburg; Peter Hagmann, Erlenbach am Main; Peter Herbrechtsmeier, Königstein; Otto Kretzschmar, Einhausen; Bernhard Seiferling, Goldbach, all of Germany; Michele De Lucchi, Angera, Italy; Torsten Fritze; Masahiko Cubo, both of Milan, Italy

[73] Assignee: Ciba Geigy Corporation, Tarrytown, N.Y.

[21] Appl. No.: 434,088

[22] Filed: May 3, 1995

[30] Foreign Application Priority Data

May 4, 1994 [EP] European Pat. Off. ..... 94810260

[51] Int. Cl.[6] ..... B65D 81/24

[52] U.S. Cl. ..... 206/5.1; 134/901; 206/205; 206/461

[58] Field of Search ..... 206/5.1, 205, 461, 206/467, 468, 469, 470, 471, 484, 462, 463, 464, 465; 134/901; 422/300

[56] References Cited

U.S. PATENT DOCUMENTS

| | | | |
|---|---|---|---|
| 3,472,368 | 10/1969 | Hellstrom | 206/469 |
| 3,618,751 | 11/1971 | Rich | 206/219 |
| 3,621,989 | 11/1971 | Pregont | 206/45.31 |
| 4,301,923 | 11/1981 | Vuorento | 206/484 |
| 4,337,858 | 7/1982 | Thomas et al. | 206/5.1 |
| 4,691,820 | 9/1987 | Martinez | 206/205 |
| 5,224,593 | 7/1993 | Bennett | 206/5.1 |
| 5,375,698 | 12/1994 | Ewart et al. | 206/5.1 |
| 5,467,868 | 11/1995 | Abrams et al. | 206/5.1 |
| 5,909,104 | 4/1995 | Lovell | 206/5.1 |

FOREIGN PATENT DOCUMENTS

| | | |
|---|---|---|
| 2560521 | 5/1984 | European Pat. Off. . |
| 0299124 | 1/1989 | European Pat. Off. . |
| 2101477 | 8/1971 | Germany . |

*Primary Examiner*—Bryon P. Gehman
*Attorney, Agent, or Firm*—Edward McC. Roberts; R. Scott Meece; Michael U. Lee

[57] ABSTRACT

The blister pack comprises a base portion and a cover layer. The base portion comprises a hollow chamber that contains a soft hydrophilic contact lens and a sterile aqueous preserving solution, and a substantially flat flange that extends right round the outside of the hollow chamber. The cover layer is releasably sealed to the flange in a sealing zone that extends right round the circumference of the hollow chamber. The flange comprises a grip region that extends from one side of the hollow chamber beyond the sealing zone and is covered by a corresponding grip region of the cover layer but is not sealed thereto. The hollow chamber comprises a dish-shaped main chamber and, adjoining the side of that main chamber, a secondary chamber in the shape of a channel tapering on all sides away from the main chamber, the main chamber making a smooth transition into the secondary chamber, and the main chamber and the secondary chamber together having a drop-shaped contour in the plane of the flange, the tip of which contour is directed towards the grip region of the flange. Provided in the grip region of the flange is an oval opening by means of which the overlying grip region of the cover layer can be lifted from the flange. A support element that is angled with respect to the plane of the flange is arranged in the grip region of the flange. An angled grip element or facilitating the handling of the blister pack is arranged at the edge of the flange on both sides of the hollow chamber. The base portion is so shaped that the blister packs can be nested in pairs with their undersides one inside the other, in each case the hollow chamber of one blister pack lying in the region of the grip region of the other blister pack. The blister pack is extremely handy, space-saving and stable, requires only an extremely small amount of preserving solution and enables the contact lens it contains to be removed especially easily.

29 Claims, 4 Drawing Sheets

BLISTER PACK FOR AN OPTICAL LENS

Figure 1:
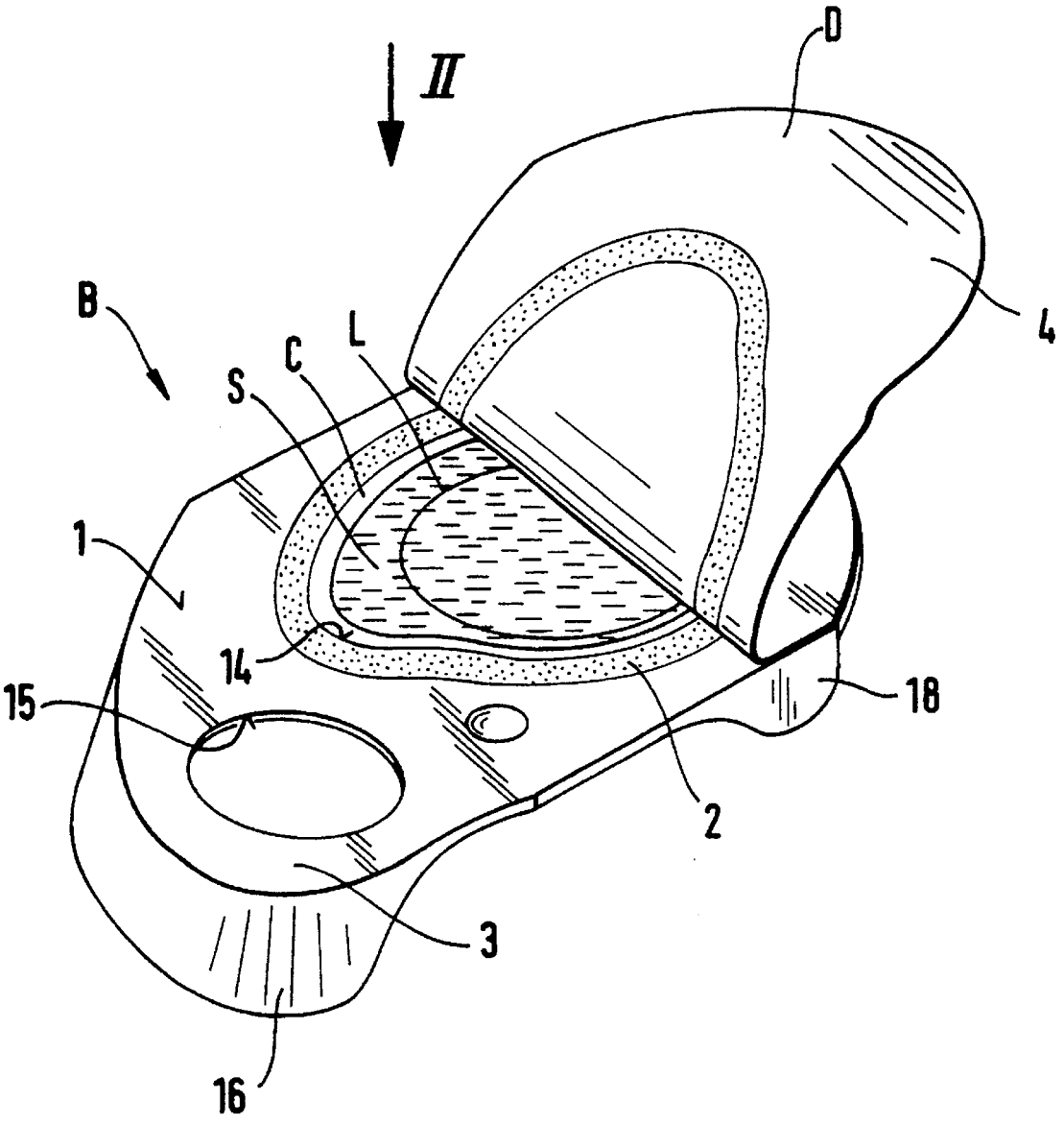

The present invention relates to a blister pack for an optical lens, especially a soft hydrophilic contact lens, according to the preamble of the independent patent claim.

Soft hydrophilic contact lenses are generally manufactured from hydrophilic polymer material, such as, for example, copolymers of hydroxyethyl methacrylate (HEMA), and, depending on the composition of the polymer, they may have a water content of from 20% to 90% or more. Such contact lenses have to be preserved and stored in a sterile aqueous solution, usually an isotonic saline solution, in order to prevent them from drying out and to maintain them in a state ready for use.

A blister pack of the generic type intended for such soft hydrophilic contact lenses is described in U.S. Pat. No 691,820 (EP-B-0 223 581). The hollow chamber of that pack, which chamber accommodates the contact lens, is deliberately not matched to the shape of the contact lens. In order to facilitate the removal of the contact lens, the hollow chamber is provided with a slide ramp in the form of an inclined face that occupies the entire width of the hollow chamber and extends from the base of the hollow chamber into the plane of the flange. Owing to its specific form, that pack requires an unnecessarily large volume of preserving solution and, as practical tests have shown, is still relatively awkward to handle, the preserving solution being relatively easily spilt when the pack is being opened.

The present invention is to avoid those disadvantages of the known blister pack. Specifically, a blister pack of the generic type is to be improved in respect of its practical handling and the amount of preserving solution it requires.

The blister pack according to the invention, which achieves that aim, is defined in the independent claim. Advantageous developments and arrangements are to be found in the dependent claims.

The arrangement according to the invention of the hollow chamber in the shape of a drop permits, on the one hand, owing to its upward inclination, an especially easy removal of the contact lens from the base portion and, on the other hand, owing to the fact that the form of the hollow chamber is closely matched to the shape of the contact lens, enables the amount of preserving solution required to be reduced to an extremely small volume.

With the arrangement according to claim 2, the cover layer is especially easy to grip for the purpose of pulling it off from the base portion.

The support element according to claim 3 imparts a high degree of tipping resistance to the blister pack according to the invention if it is placed on a support during opening. The same applies to the rear support element according to claim 4.

The side grip elements according to claim 5 make it easier to hold the blister pack firmly if it is opened in the hand.

The arrangement of the blister pack according to claim 6 enabling it to be stacked in pairs allows several blister packs to be accommodated in a space-saving manner in a box or similar outer packaging.

The forms of the base portion and the support elements described in claims 7 to 10 contribute to an especially ergonomic and easy practical handling of the blister pack.

The placing of several blister packs next to one another in a row according to claim 11 constitutes an especially economical and advantageous packing form.

Figure 2:
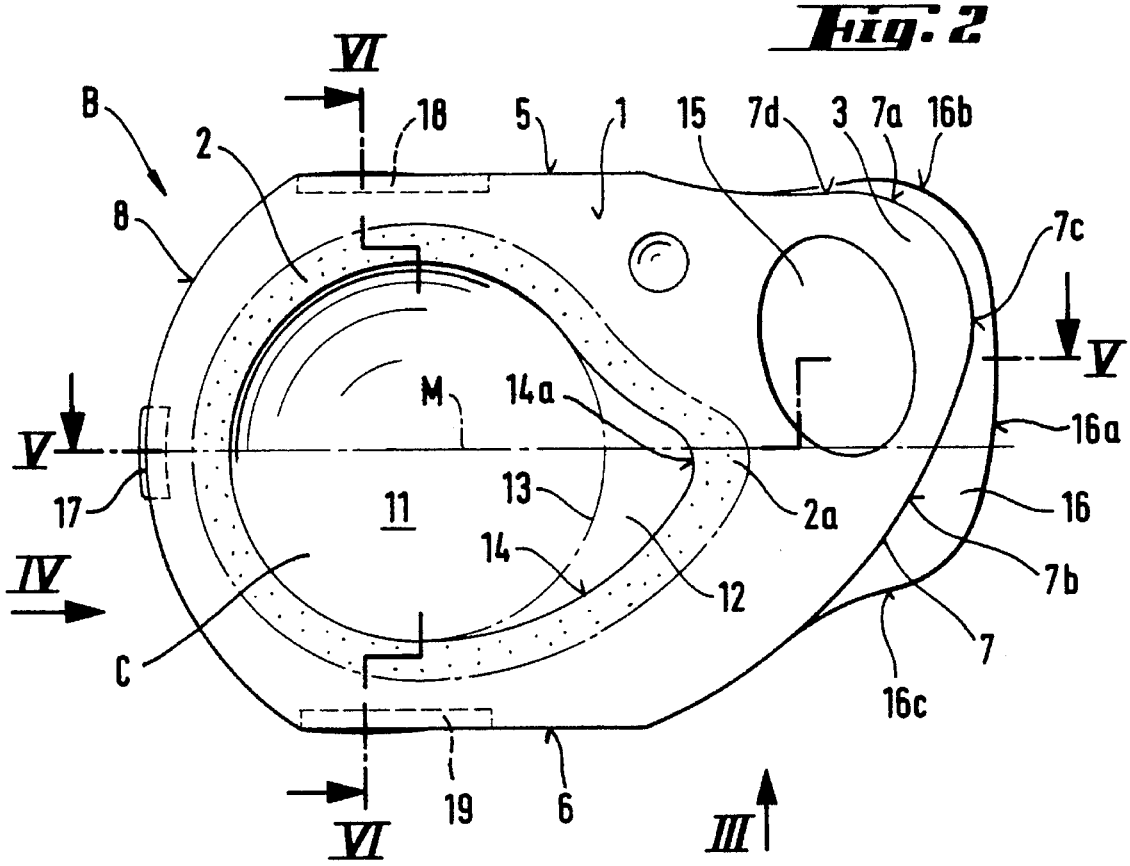
Figure 3:
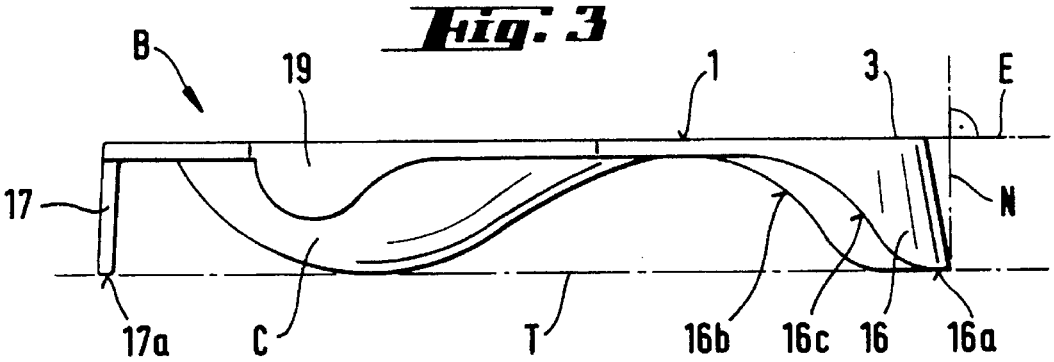
Figure 4:
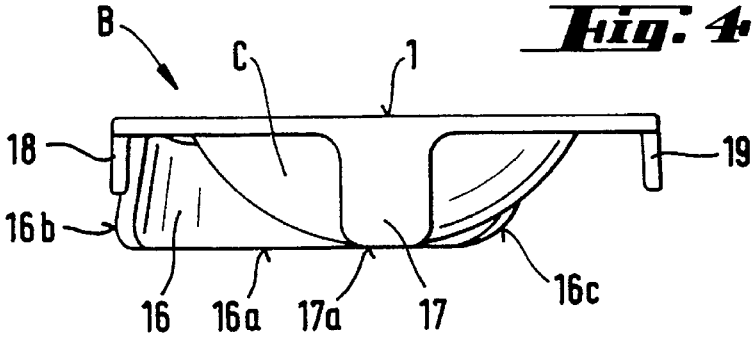
Figure 5:
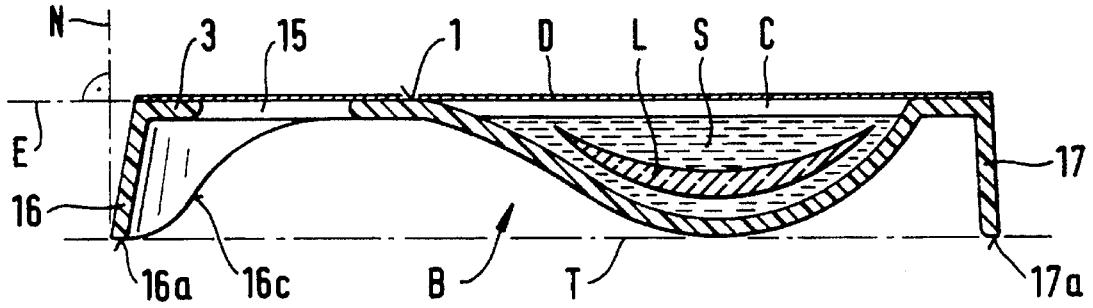
Figure 6:
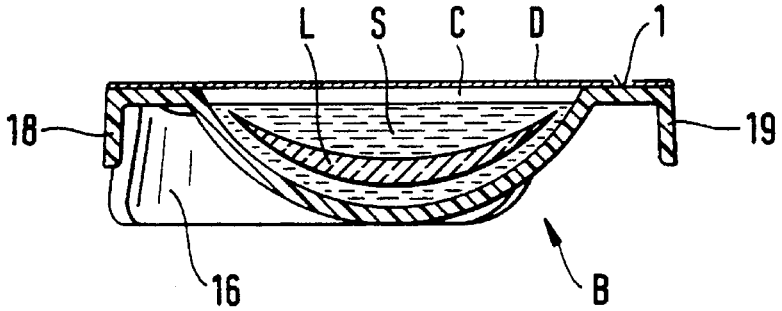
Figure 7:
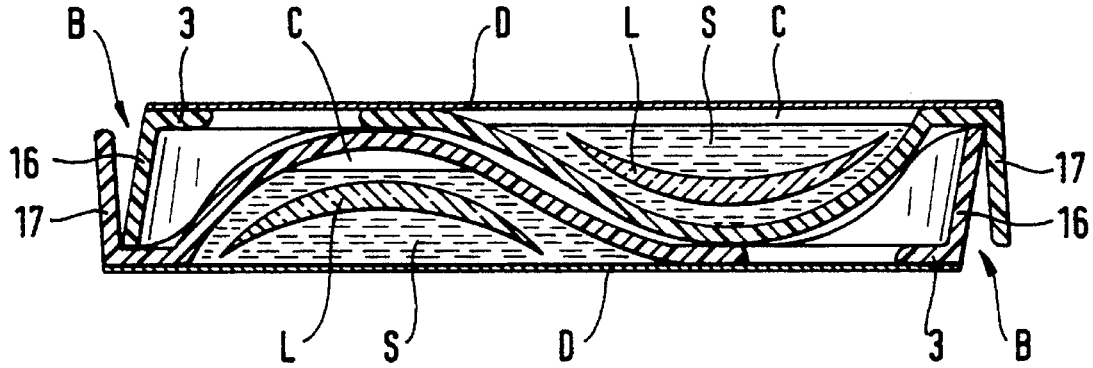
Figure 8:
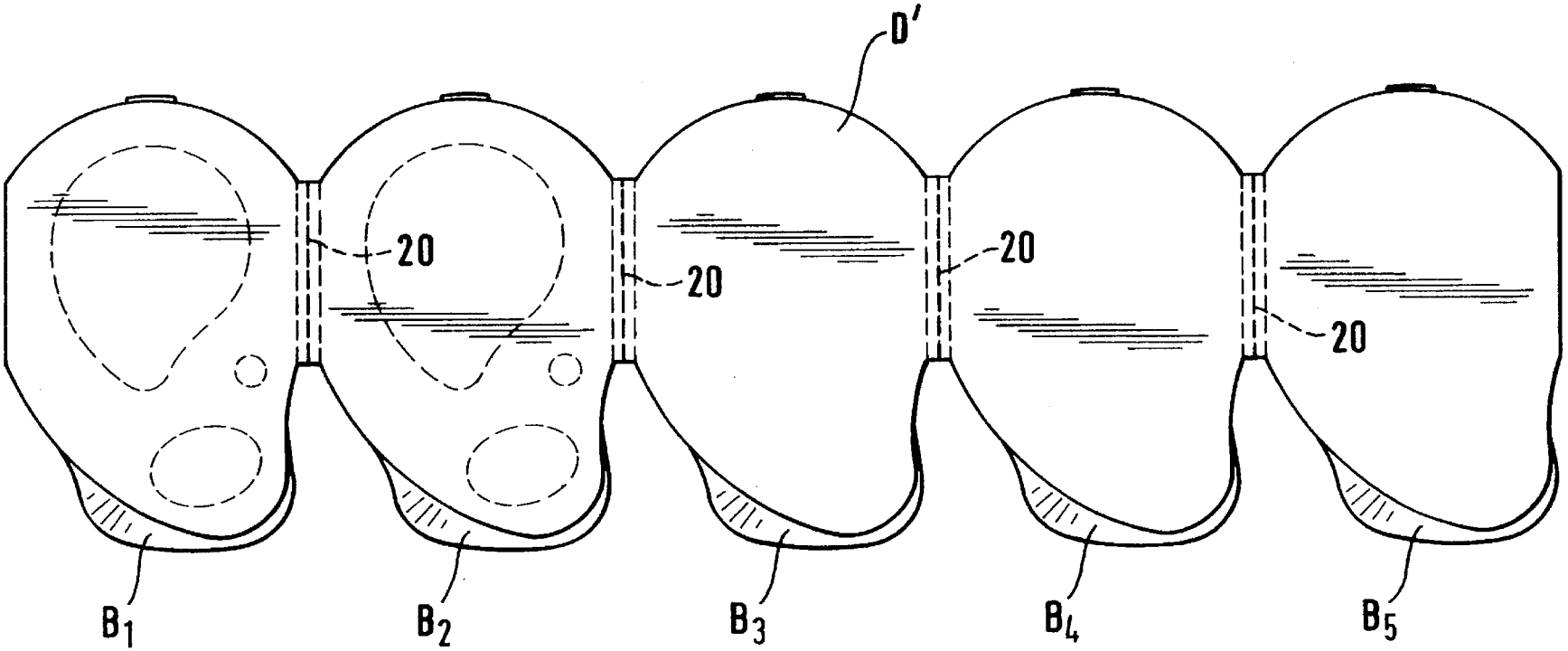

Further details and advantages of the blister pack according to the invention can be found in the following detailed description of an embodiment in conjunction with the drawings, in which:

FIG. 1 is an oblique view of the blister pack according to the invention,

FIG. 2 is a view of the base portion of the blister pack from above in the direction of arrow II of FIG. 1, FIG. 3 is a side view of the base portion in the direction of arrow III of FIG. 2, FIG. 4 is a side view of the base portion from behind in the direction of arrow IV of FIG. 2, FIG. 5 is a longitudinal section through the blister pack according to the line V—V of FIG. 2, FIG. 6 is a transverse section through the blister pack according to the line VI—VI of FIG. 2, FIG. 7 is a longitudinal section analogous to that of FIG. 5 through two blister packs stacked one inside the other, and FIG. 8 is a plan view of five blister packs arranged side by side in a row and connected to one another by means of a common continuous cover layer.

As shown, the blister pack comprises a base portion B and a cover layer D. The base portion B comprises a hollow chamber C that accommodates a soft hydrophilic contact lens L and a sterile preserving solution S suitable for the type of lens concerned, and also a substantially flat flange 1 that extends right round the outside of, or surrounds, the hollow chamber C. The cover layer D, which is likewise flat, is releasably sealed to the flange 1 in a sealing zone 2 that extends round the circumference of the hollow chamber C. On one side of the hollow chamber C, the flange 1 is slightly wider and has there a grip region 3 that extends away from the hollow chamber C beyond the sealing zone 2 and is covered by a corresponding grip region 4 of the cover layer D. In those grip regions 3 and 4, the base portion B, or its flange 1, and the cover layer D are not sealed to one another, so that, at that site, the cover layer can readily be lifted from the flange and then pulled off the base portion. The two grip regions 3 and 4 of the flange 1 and the cover layer D form grip means for separating the cover layer from the base portion, or its flange. In FIG. 1, the cover layer D is shown partially removed from the base portion.

Thus far, that is to say, in that general form, the blister pack according to the invention corresponds fully and completely to the conventional contact lens blister packs known, for example, from U.S. Pat. No. 4,691,820 already mentioned in the introduction. The base portion B can be manufactured by injection-moulding or deep-drawing, for example from polypropylene. The cover layer D may be, for example, a laminate comprising an aluminium foil and a polypropylene film. The cover layer may be printed with information regarding the contact lens contained in the pack or with other information for the end user or the dealer. The sealing of the cover layer to the base portion, or its flange, can be effected by the action of heat or ultrasound or by means of some other suitable bonding process. Other suitable materials and processes for the manufacture of such a blister pack are known to the person skilled in the art and are described, for example, in the already-mentioned U.S. Pat. No. 4,691,820 which is hereby declared to be an integral part of the present patent description.

The differences between the blister pack according to the invention and the conventional blister packs of the generic type consist essentially in the special form of the base portion B. The following detailed explanations therefore concentrate especially on that form.

The arrangement of the base portion B, or its flange 1, can best be seen in the plan view according to FIG. 2. The flat flange 1 has, in the broadest sense, an approximately rectangular shape and is bounded at its two sides by two parallel, substantially straight edges 5 and 6. On its other two sides, the flange 1 is bounded by a curved front edge 7 and a curved rear edge 8. The relative terms "front", "rear" and "side" refer here and hereinafter to the longitudinal axis of the flange 1, or of the blister pack in general, which axis is defined by the central line M between the two straight bounding edges 5 and 6, "front" denoting that portion of the flange 1 which comprises the grip region 3. Accordingly, the rear region of the base portion B, or of its flange 1, is to be understood as being that region of the base portion B, or of the flange 1, which lies opposite the grip region 3 with respect to the hollow chamber C. The two straight bounding edges 5 and 6 are accordingly located at the sides. The upper side is to be understood as being that side of the base portion B which is provided with the cover layer D, and the underside is accordingly to be understood as being that side of the base portion which lies opposite the upper side and is remote from the cover layer D.

The hollow chamber C accommodating the contact lens and the preserving solution is arranged in the rear and central region of the base portion. The hollow chamber C comprises two portions which make a continuous and smooth transition into one another. The first portion of the hollow chamber C is a substantially dish-shaped main chamber 11, the dimensions of which are so chosen that it can accommodate contact lenses of all current sizes but is not substantially larger than those lenses. A practical value for the diameter of the main chamber 11 measured in the plane E of the flange 1, is, for example, approximately 20 mm, and a practical value for the depth of the main chamber measured with respect to the plane E of the flange 1 is approximately 6 mm. The second portion of the hollow chamber C is a secondary chamber 12, the shape of which can best be compared to that of a tapering or funnel-shaped channel that becomes continuously narrower and flatter in the direction away from the main chamber 11. That secondary chamber 12 adjoins the side, or, in the above terminology, the front, of the main chamber 11 and, as already mentioned, makes a smooth transition into the latter. The separating line 13 inserted in FIG. 2 between the two hollow chamber portions can therefore not be seen in reality. The geometrical spatial form of the secondary chamber 12 is such that the main chamber 11 and the secondary chamber 12 together, that is to say, the hollow chamber C, have an asymmetrical drop-shaped contour 14 in the plane E of the flange 1. The tip 14*a* of the "drop" lies approximately on the central line M, or the longitudinal axis, of the base portion and is directed forwards towards the grip region 3 of the flange 1. The already-mentioned sealing zone 2 is located round the circumference, or the contour 14, of the hollow chamber C. Owing to the drop shape of the contour 14, the sealing zone 2 also has a tip 2*a* at which the pulling-off begins and by which the pulling-off is facilitated.

The drop shape of the hollow chamber C permits a very simple and easy removal of the lens, there being only an extremely small dead volume which cannot be occupied by the lens, so that only an extremely small amount of preserving solution is necessary for the reliable preservation of the lens.

Unlike the rear region of the flange 1, its front region, that is to say, its grip region 3, has an asymmetrical form with respect to the central line M and has substantially the shape of a rounded saw tooth having one relatively steep (i.e. less sharply inclined with respect to the central line M) and one relatively flat (i.e. more sharply inclined with respect to the central line M) convexly curved flank 7*a* and 7*b*, respectively, and a rounded tip 7*c* between them. The rounded tip 7*c* lies approximately centrally between the central line M and the straight side bounding edge 5. The steeper flank 7*a* makes a transition into a slightly concavely curved portion 7*d* which is adjoined by the straight side bounding edge 5. The two flanks 7*a* and 7*b*, the rounded tip 7*c* and the concave edge region 7*d* together form the curved bounding edge 7 of the front region 3 of the flange 1.

Arranged in the flange 1, approximately centrally between the rounded tip 7*c* of the grip region 3 and the tip 14*a* of the drop-shaped contour 14 of the hollow chamber C, is an opening 15 of substantially oval or elliptical shape, the longitudinal axis of which forms an angle of approximately 60° with the central line M. The size of the opening 15 is such that the fingertip of the person handling the blister pack can partially reach through that opening and thus lift the overlying grip region 4 of the cover layer D from the grip region 3 of the flange 1. As a result, the cover layer D can be readily gripped and pulled off the base portion B. In addition, the opening 15 provides a more secure grip when the blister pack is held in the hand.

Arranged in the grip region 3 of the flange 1 is a front support element 16 that is angled with respect to the plane E of the flange 1, extends on both sides of the rounded tip 7*c* of the grip region 3 into the flanks 7*a* and 7*b* of the front curved bounding edge 7 of the grip region 3, and is inclined slightly outwards with respect to a direction N perpendicular to the plane E of the flange 1. The support element 16 has a lower bounding edge 16*a* parallel to the plane E of the flange 1, and two curved side bounding edges 16*b* and 16*c*. The outward inclination of the support element 16 is lesser in the region of the steeper flank 7*a* of the grip region 3 and increases continuously in the direction towards the flatter flank 7*b* of the grip region 3. The minimum and maximum values of the outward inclination with respect to the direction N of the perpendicular onto the plane E of the flange 1 are approximately from 2° to 5° and 10° to 20°, respectively.

Arranged in the rear region of the flange 1, approximately in the region of the central line M, is a rear support element 17 that is angled downwards (slightly outwards) with respect to the flange 1 at an angle of approximately from 90° to 95° to the plane E of the flange 1 and likewise has a lower bounding edge 17*a* parallel to the plane E of the flange 1. In contrast to the front support element 16, however, the rear support element 17 is comparatively narrow.

The heights of the front and rear support elements 16 and 17 measured perpendicularly to the plane E of the flange 1 are preferably equal and are such that an imaginary plane T tangential to their lower bounding edges 16*a* and 17*a* just touches the underside of the hollow chamber C or lies slightly below it (FIG. 3).

The relatively wide front support element 16 and the relatively narrow rear support element 17 together form a kind of tripod which imparts a high degree of stability (tipping resistance) to the blister pack when that pack is placed on a fairly flat support. The rear support element 17 may also be omitted, in which case the blister pack would be supported with almost the same degree of tipping resistance on the front support element 16 and the underside of the hollow chamber C. The front support element 16 can of course also be divided into two or more narrower elements which, together, have substantially the same form as the support element 16.

Owing to its special shaping and arrangement, the front support element 16 serves at the same time as an auxiliary grip for the easy and secure handling of the blister pack. Owing to the shape of the base portion, a user intuitively grips the blister pack in such a manner that he places his index finger under the grip region 3 between the front support element 16 and the tip 14*a* of the drop-shaped hollow chamber C and presses with his thumb from the outside against the front support element 16. The described special shaping of the grip region 3 and of the front support element 16 is very ergonomic and permits easy and secure grasping of the blister pack during the removal of the cover layer D from the base portion B.

In order further to facilitate handling and to offer the user alternative grips, there are arranged at the base portion B, on both sides of the flange 1 and approximately at the level of the greatest width of the hollow chamber C, two grip elements 18 and 19 that are angled downwards approximately at right angles to the plane of the flange 1 but are only approximately half as tall as the two support elements 16 and 17. Making use of those grip elements 18 and 19, the user holds the blister pack in principle with three fingers which press against the two grip elements 18 and 19 and the rear support element 17.

As is shown especially in FIG. 7, the blister pack according to the invention can be stacked in pairs. In each case two blister packs, or base portions B, are nested with their undersides one inside the other, the hollow chamber C of one pack lying in the grip region 3 of the other pack and vice versa; in other words, the two packs are arranged so that they are rotated through 180° with respect to one another and are offset only slightly with respect to one another in the longitudinal direction. The flanges 1 of the two packs are parallel. Thus, several blister packs can be accommodated in a very space-saving manner in a common box or some other outer packaging.

An especially advantageous development of the blister pack according to the invention consists in arranging side by side in a row several base portions, according to FIG. 8, for example, five base portions B1–B5, and connecting them to one another by means of a common continuous cover layer D'. The cover layer D' may be provided with predetermined breaking lines 20 in the region of the separating lines between the individual base portions B1–B5 in order to facilitate separation of the individual packs. As is readily appreciated, such combined packs can also be stacked in pairs. Combined packs of that type are especially advantageous for disposable contact lenses: for example, three sets of two units each comprising five blister packs may be contained in one box.

As is evident from the above description, the blister pack according to the invention is extremely handy, space-saving and stable, it can be opened simply and easily, requires only an extremely small amount of preserving solution and enables the contact lens it contains to be removed especially easily.

What is claimed is:

1. A blister pack for an optical lens having a base portion and a cover layer, the base portion comprising a hollow chamber, said hollow chamber containing the optical lens and a sterile preserving solution and having an upper opening periphery, and comprising a substantially flat flange that extends in a plane around the opening periphery of the hollow chamber;

the cover layer being substantially flat and being releasably sealed to the flange in a sealing zone that extends right around the opening periphery of the hollow chamber; and the flange comprising a front grip region, a rear region and two sides, with respect to the hollow chamber, the front grip region extending from the hollow chamber beyond the sealing zone and being at least partially covered by a corresponding grip region of the cover layer but not being sealed thereto so that the grip regions of the flange and the cover layer forming grip means for separating the cover layer from the flange, wherein the hollow chamber comprises a substantially hemispherical main chamber and, adjoining a side of that main chamber, a secondary chamber, wherein the main chamber contains said optical lens, is not significantly larger than said optical lens and makes a substantially smooth transition into the secondary chamber, wherein the secondary chamber is narrower than the main chamber, substantially in the shape of a channel tapering away from the main chamber and forming a tip towards the front grip region, thereby the secondary chamber provides means for easy removal of the lens from the hollow chamber and minimizes the amount of the preserving solution contained in the hollow chamber.

2. A blister pack of claim 1, wherein said front grip region of said flange includes a substantially oval opening by means of which said cover layer can be lifted from said front grip region of said flange.

3. A blister pack of claims 1 or 2, wherein said front grip region includes at least one front support element which is angled with respect to said plane of said flange and which prevents said blister pack from tipping when said blister pack is placed on a flat support.

4. A blister pack of claims 1 or 2, wherein said front grip region includes at least one front support element which is angled with respect to said plane of said flange and which prevents said blister pack from tipping when said blister pack is placed on a flat support, and wherein at least one rear support element which is angled with respect to said rear region of said flange.

5. A blister pack of claims 1 or 2, wherein, to facilitate handling, grip elements which are angled with respect to said plane are arranged at edges of said two sides.

6. A blister pack of claim 1 or 2, wherein said front grip region includes at least one front support element which is angled with respect to said plane of said flange and which prevents said blister pack from tipping when said blister pack is placed on a flat support, and wherein, to facilitate handling, grip elements which are angled with respect to said plane are arranged at edges of said two sides.

7. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said rear region of said flange, and wherein, to facilitate handling, grip elements which are angled with respect to said plane are arranged at edges of said two sides.

8. A blister pack of claims 1 or 2, wherein said blister pack defines a shape allowing the blister pack to be packaged in pairs in a manner such that two blister packs, rotated through 180° with respect to one another, can be nested with their undersides one inside the other, wherein each hollow chamber of each blister pack lies adjacent the front grip region of the other blister pack, and wherein the flanges of each blister pack are parallel to, and offset slightly from, one another.

9. A blister pack of claims 1 or 2, wherein said front grip region of said flange includes at least one front support element which is angled with respect to the plane of said flange and which prevents said blister pack from tipping when said blister pack is placed on a flat support, and wherein said blister pack defines a shape allowing the blister pack to be packaged in pairs in a manner such that two blister packs, rotated through 180° with respect to one another, can be nested with their undersides one inside the other, wherein each hollow chamber of each blister pack lies adjacent the front grip region of the other blister pack, and wherein the flanges of each blister pack are parallel to, and offset slightly from, one another.

10. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, and wherein said blister pack defines a shape allowing said blister pack to be packaged in pairs in a manner such that two blister packs, rotated through 180° with respect to one another, can be nested with their undersides one inside the other, wherein each hollow chamber of each blister pack lies adjacent said front grip region of the other blister pack, and wherein said flanges of each blister pack are parallel to, and offset slightly from, one another.

11. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein, to facilitate handling, grip elements which are angled with respect to said plane are arranged at edges of said two sides, and wherein said blister pack defines a shape allowing said blister pack to be packaged in pairs in a manner such that two blister packs, rotated through 180° with respect to one another, can be nested with their undersides one inside the other, wherein each hollow chamber of each blister pack lies adjacent said front grip region of the other blister pack, and wherein said flanges of each blister pack are parallel to, and offset slightly from, one another.

12. A blister pack of claims 1 or 2, wherein said flange is bounded by a curved from bounding edge and a curved rear bounding edge, respectively, in said front grip region and in said rear region, and wherein said flange is bounded on said two sides by two parallel straight-side bounding edges.

13. A blister pack of claims 1 or 2, wherein said front grip region includes at least one front support element which is angled with respect to said plane of said flange and which prevents said blister pack from tipping when said blister pack is placed on a flat support, and wherein said flange is bounded by a curved front bounding edge and a curved rear bounding edge, respectively, in said front grip region and in said rear region, bounded on said two sides by two parallel straight-side bounding edges.

14. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, and wherein said flange is bounded by a curved front bounding edge and a curved rear bounding edge, respectively, in said front grip region and in said rear region, and wherein said flange is bounded on said two sides by two parallel straight-side bounding edges.

15. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane defined by said flange is arranged on said rear region, wherein, to facilitate handling, grip elements which are angled with respect to said plane are arranged at edges of said two sides, and wherein said flange is bounded by a curved front bounding edge and a curved rear bounding edge, respectively, in said front grip region and in said rear region, and wherein said flange is bounded on said two sides by two parallel straight-side bounding edges.

16. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein, to facilitate handling, grip elements which are angled with respect to said plane are arranged at edges of said two sides, wherein said blister pack defines a shape allowing said blister pack to be packaged in pairs in a manner such that two blister packs, rotated through 180° with respect to one another, can be nested with their undersides one inside the other, wherein each hollow chamber of each blister pack lies adjacent said front grip region of the other blister pack, and wherein said flanges of each blister pack are parallel to, and offset slightly from, one another, and wherein said flange is bounded by a curved front bounding edge and a curved rear bounding edge, respectively, in said front grip region and in said rear region, and wherein said flange is bounded on said two sides by two parallel straight-side bounding edges.

17. A blister pack of claims 1 or 2, wherein said flange is bounded by a curved front bounding edge and a curved rear bounding edge, respectively, in said front grip region and in said rear region, and wherein said flange is bounded on said two sides by two parallel straight-side bounding edges, and wherein said front grip region has an asymmetrical form with respect to a central line that extends centrally between and parallel to the two side bounding edges, and wherein the front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks.

18. A blister pack of claims 1 or 2, wherein said front grip region includes at least one front support element which is angled with respect to said plane of said flange and which prevents said blister pack from tipping when said blister pack is placed on a flat support, wherein said flange is bounded by a curved front bounding edge and a curved rear bounding edge, respectively, in said front grip region and in said rear region, and wherein said flange is bounded on said two sides by two parallel straight-side bounding edges, and wherein said front grip region has an asymmetrical form with respect to a central line that extends centrally between and parallel to the two side bounding edges, and wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks.

19. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein said flange is bounded by a curved front bounding edge and a curved rear bounding edge, respectively, in said front grip region and in said rear region, and wherein said flange is bounded on said two sides by two parallel straight-side bounding edges, wherein said from grip region has an asymmetrical form with respect to a central line that extends centrally between and parallel to the two side bounding edges, and wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks.

20. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane defined by said flange is arranged on said rear region, wherein, to facilitate handling, grip elements which are angled with respect to said plane are arranged at edges of said two sides, wherein said flange is bounded by a curved front bounding edge and a curved rear bounding edge, respectively, in said front grip region and in said rear region, and wherein said flange is bounded on said two sides by two parallel straight-side bounding edges, and wherein said front grip region has an asymmetrical form with respect to a central line that extends centrally between and parallel to said two side bounding edges, and wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks.

21. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane defined by said flange is arranged on said rear side, wherein, to facilitate handling, grip elements which are angled with respect to said plane are arranged at edges of said two sides, wherein said blister pack defines a shape allowing said blister pack to be packaged in pairs in a manner such that two blister packs, rotated through 180° with respect to one another, can be nested with their undersides one inside the other, wherein each hollow chamber of each blister pack lies adjacent said front grip region of the other blister pack, and wherein said flanges of each blister pack are parallel to, and offset slightly from, one another, wherein said flange is bounded by a curved front bounding edge and a curved rear bounding edge, respectively, in said front grip region and in said rear region, and wherein said flange is bounded on said two sides by two parallel straight-side bounding edges, wherein said front grip region has an asymmetrical form with respect to a central line that extends centrally between and parallel to said two side bounding edges, and wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks.

22. A blister pack of claims 1 or 2, wherein said front grip region includes at least one front support element which is angled with respect to said plane of said flange and which prevents said blister pack from tipping when said blister pack is placed on a flat support, and wherein said front support element is arranged such that the finger of a person handling said blister pack may be positioned between said front grip region and said hollow chamber, thereby providing an auxiliary grip region.

23. A blister pack of claims 1 or 2, wherein said front grip region includes at least one front support element which is angled with respect to said plane of said flange and which prevents said blister pack from tipping when said blister pack is placed on a flat support, wherein said front grip region has an asymmetrical form with respect to a central line that extends centrally between and parallel to said two sides, wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, and wherein said front support element extends on both sides of said rounded tip of said front grip region into said two flanks and is inclined slightly outward with respect to a direction perpendicular to said plane, said front support element being inclined outward to a lesser degree at said relatively steep flank of said front grip region than at said relatively flat flank of said front grip region.

24. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein said front grip region has an asymmetrical form with respect to a central line that extends centrally between and parallel to said two sides, wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, and wherein said front support element extends on both sides of said rounded tip of said front grip region into said two flanks and is inclined slightly outward with respect to a direction perpendicular to said plane, said support element being inclined outward to a lesser degree at said relatively steep flank of said front grip region than at said relatively flat flank of said front grip region.

25. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein said front grip region has an asymmetrical form with respect to a central line that extends centrally between and parallel to said two sides, wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, wherein, to facilitate handling, grip elements which are angled with respect to said plane are arranged at edges of said two sides, and wherein said front support element extends on both sides of said rounded tip of said front grip region into said two flanks and is inclined slightly outward with respect to a direction perpendicular to said plane, said support element being inclined outward to a lesser degree at said relatively steep flank of said front grip region than at said relatively flat flank of said front grip region.

26. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein said front grip region has an asymmetrical form with respect to a central line that extends centrally between and parallel to said two sides, wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, wherein, to facilitate handling, grip elements which are angled with respect to said plane are arranged at edges of said two sides, wherein said blister pack defines a shape allowing said blister pack to be packaged in pairs in a manner such that two blister packs, rotated through 180° with respect to one another, can be nested with their undersides one inside the other, wherein each hollow chamber of each blister pack lies adjacent said front grip region of the other blister pack, and wherein said flanges of each blister pack are parallel to, and offset slightly from, one another, wherein said flange is bounded by a curved front bounding edge and a curved rear bounding edge, respectively, in said front grip region and in said rear region, and wherein said flange is bounded on said two sides by two parallel straight-side bounding edges, and wherein said front support element extends on both sides of said rounded tip of said front grip region into said two flanks and is inclined slightly outward with respect to a direction perpendicular to said plane, said support element being inclined outward to a lesser degree said relatively steep flank of said front grip region than at said relatively flat flank of said front grip region.

27. A blister pack of claims 1 or 2, wherein said front grip region includes at least one front support element which is angled with respect to said plane of said flange and which prevents said blister pack from tipping when said blister pack is placed on a flat support, wherein at least one rear support element which is angled with respect to said plane is arranged on said rear region, wherein said front grip region has an asymmetrical form with respect to a central line that extends centrally between and parallel to said two sides, wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, wherein, to facilitate handling, grip elements which are angled with respect to said plane are arranged at edges of said flange on said two sides, wherein said blister pack defines a shape allowing said blister pack to be packaged in pairs in a manner such that two blister packs, rotated through 180° with respect to one another, can be nested with their undersides one inside the other, wherein each hollow chamber of each blister pack lies adjacent said front grip region of the other blister pack, and wherein said flanges of each blister pack are parallel to, and offset slightly from, one another, wherein said flange is bounded by a curved front bounding edge and a curved rear bounding edge, respectively, in said front grip region and in said rear region, and wherein said flange is bounded on said two sides by two parallel straight-side bounding edges, wherein said front grip region has an asymmetrical form with respect to a central line that extends centrally between and parallel to said two side bounding edges, and wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, and wherein said front support element extends on both sides of said rounded tip of said front grip region into said two flanks and is inclined slightly outward with respect to a direction perpendicular to said plane, said support element being inclined outward to a lesser degree at said relatively steeper flank of said front grip region than at said relatively flat flank of said front grip region.

28. A blister pack of claims 1 or 2, wherein said front grip region includes at least one front support element which is angled with respect to said plane of said flange and which prevents said blister pack from tipping when said blister pack is placed on a flat support, wherein said front grip region has an asymmetrical form with respect to a central line that extends centrally between and parallel to said two sides, wherein said front grip region is substantially in the shape of a rounded saw tooth having a relatively steep flank, which inclined to a less extent with respect to said central line, and a relatively flat flank, which is more sharply inclined with respect to said central line, and a rounded tip lying between said two flanks, wherein said front support element is arranged such that the finger of a person handling said blister pack may be positioned between said front support element and said hollow chamber, thereby providing an auxiliary grip region, and wherein said front support element extends on both sides of said rounded tip of said front grip region into said two flanks and is inclined slightly outward with respect to a direction perpendicular to said plane, said support element being inclined outward to a lesser degree at said relatively steep flank of said front grip region than in the region of said relatively flatt flank of said front grip region.

29. A package including at least two blister packs of claim 1 or 2, wherein at least two base portions are arranged adjacent one another and are affixed to one another by means of a common continuous cover layer.

* * * * *